US010563611B2

(12) United States Patent
Ulrey et al.

(10) Patent No.: US 10,563,611 B2
(45) Date of Patent: Feb. 18, 2020

(54) FUEL DELIVERY SYSTEM AND METHOD FOR OPERATION OF A FUEL DELIVERY SYSTEM

(71) Applicant: Ford Global Technologies, LLC, Dearborn, MI (US)

(72) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 265 days.

(21) Appl. No.: 14/577,093

(22) Filed: Dec. 19, 2014

(65) Prior Publication Data

US 2016/0177861 A1 Jun. 23, 2016

(51) Int. Cl.
*F02D 41/38* (2006.01)

(52) U.S. Cl.
CPC .... *F02D 41/3854* (2013.01); *F02D 2041/389* (2013.01); *F02D 2200/0602* (2013.01)

(58) Field of Classification Search
CPC ..... F02D 41/3854; F02D 2041/389; F02D 2200/0602; F02M 37/0058
USPC ... 123/294, 495, 497, 510, 198 C, 516, 446; 701/102, 104
See application file for complete search history.

(56) References Cited

U.S. PATENT DOCUMENTS 5,598,817 A * 2/1997 Igarashi ..... F02D 41/062 123/179.17
5,715,797 A * 2/1998 Minagawa ..... F02D 41/3082 123/478
5,823,262 A 10/1998 Dutton
5,941,214 A * 8/1999 Hoffmann ..... F02D 41/3845 123/447
6,230,688 B1 * 5/2001 Faix ..... F02D 41/3809 123/196 R
6,609,500 B2 * 8/2003 Ricco ..... F02D 33/003 123/446
7,438,051 B2 * 10/2008 Wachtendorf ..... F02D 41/2464 123/446
7,464,696 B2 12/2008 Furusawa et al.
7,640,916 B2 * 1/2010 Ulrey ..... F02D 33/003 123/446
9,303,583 B2 * 4/2016 Surnilla ..... F02D 41/3094
2005/0199219 A1 * 9/2005 Utsumi ..... F02D 41/22 123/458

(Continued)

OTHER PUBLICATIONS

De Cesare et al., "Electric Low Pressure Fuel Pump Control for Fuel Saving," SAE Technical Paper 2013-01-0339, 2013, doi:10.4271/2013-01-0339.

(Continued)

*Primary Examiner* — Stephen K Cronin
*Assistant Examiner* — Susan E Scharpf
(74) *Attorney, Agent, or Firm* — Geoffrey Brumbaugh McCoy Russell LLP

(57) ABSTRACT

A method for operating a fuel delivery system for an engine is provided. The method includes sending a voltage above a threshold value to a lift pressure pump, determining a volumetric efficiency of the direct injection pump when the lower pressure fuel pump is above a threshold pressure, and controlling the lift pump based on the volumetric efficiency of the direct injection pump.

20 Claims, 4 Drawing Sheets

(56) References Cited

U.S. PATENT DOCUMENTS

| | | | | |
|---|---|---|---|---|
| 2009/0090331 | A1* | 4/2009 | Pursifull | F02M 37/0058 123/446 |
| 2014/0230794 | A1* | 8/2014 | Surnilla | F02M 37/04 123/495 |
| 2016/0153384 | A1* | 6/2016 | Ulrey | F02D 41/3082 123/464 |
| 2016/0153388 | A1* | 6/2016 | Sanborn | F02M 39/00 123/458 |

OTHER PUBLICATIONS

Pursifull, Ross D., "Method and System for Supplying Liquefied Petroleum Gas to a Direct Fuel Injected Engine," U.S. Appl. No. 14/532,756, filed Nov. 4, 2014, 39 pages.

* cited by examiner

FUEL DELIVERY SYSTEM AND METHOD FOR OPERATION OF A FUEL DELIVERY SYSTEM

FIELD

The present disclosure relates to a fuel delivery system and method for operation of lower and higher pressure fuel pumps in the fuel delivery system.

BACKGROUND AND SUMMARY

Some vehicle engine systems utilizing direct in-cylinder injection of fuel include a fuel delivery system that has multiple fuel pumps for providing suitable fuel pressure to the fuel injectors. As one example, a fuel delivery system can utilize an electrically driven lower pressure fuel pump (e.g., lift pump) and a mechanically driven higher pressure fuel pump arranged respectively in series between the fuel tank and the fuel injectors. The higher and lower pressure fuel pumps may be operated in conjunction to generate a desired fuel rail pressure during engine operation.

US 2009/0090331 discloses a fuel delivery system providing pressurized fuel to direct fuel injectors. The Inventors have recognized several drawbacks with the fuel delivery system disclosed in US 2009/0090331. For instance, the control scheme for the lower and higher pressure fuel pumps uses a pump model to determine the volumetric efficiency of the higher pressure that is sensitive to 1) manufacturing variability, 2) wear, and 3) direct injection (DI) pump inlet pressure. This prior algorithm depends on an a priori determination of "full DI pump volumetric efficiency". Furthermore, the prior algorithm does not specifically put the DI pump inlet pressure at a high level to learn (i.e., self-calibrate) the volumetric efficiency associated with high DI inlet pressure. The time interval during which the pump efficiency is measured is not specified. During certain time intervals measuring the higher pressure fuel pump efficiency may be inaccurate. For instance, if the input to the higher pressure fuel pump is below a threshold value the pump efficiency measurement may not be accurate. Inaccuracies in volumetric efficiency measurements can lead to inefficient fuel delivery system operation.

The inventors have discovered a useful serendipity between controlling a lower pressure pump (e.g., lift pump) in pulsed mode and determining the higher pressure pump (e.g., DI pump) volumetric efficiency (e.g., maximum higher pressure pump volumetric efficiency). In one embodiment, each time that the lower pressure pump is operated at high pressure, the "best available" higher pressure pump volumetric efficiency can be measured and stored for us in detection of volumetric efficiency degradation (i.e., vapor detection). This self-learned calibration allows attribution of any degradation in higher pressure pump volumetric efficiency to the lowered lower pressure pump pressure. It will be appreciated that the lower pressure pump may be the higher pressure pump inlet pressure, in some examples. Thus, it may add robustness to the detection of low higher pressure pump volumetric efficiency and vapor detection. Prompt and reliable vapor detection enables a pulsed lower pressure pump in the fuel delivery system to be robust against unintended drops in fuel rail pressure (i.e., injection pressure).

As such in another embodiment, a method for operating a fuel delivery system for an engine is provided. The method includes sending a voltage above a threshold value to a lift pressure pump; and controlling the lift pump based on a volumetric efficiency of the direct injection pump determined only when the voltage sent to the lower pressure fuel pump is above the threshold value. In this way, an interval, which may be a time interval in one example, for determining volumetric efficiency of the higher pressure fuel pump is selected to provide an accurate efficiency determination. As a result, the likelihood of inaccurate pump efficiency measurements is decreased, thereby improving fuel delivery system operating efficiency.

In one example, sending the voltage above the threshold value to the lift pump is initiated responsive to implementation of a direct injection pump vapor detection routine. In this way, the volumetric efficiency determination and vapor detection routine can implemented at concurrent time intervals, thereby increasing the efficiency of the fuel delivery system.

Additionally in one example, it may be inferred that the lower pressure fuel pump pressure is greater than the threshold value when a predetermined voltage is applied to the lower pressure fuel pump for a predetermined time interval. In this way, the determination of the lower pressure fuel pump being above the threshold value is simplified.

The above advantages and other advantages, and features of the present description will be readily apparent from the following Detailed Description when taken alone or in connection with the accompanying drawings.

It should be understood that the summary above is provided to introduce in simplified forth a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

DETAILED DESCRIPTION

Figure 1:
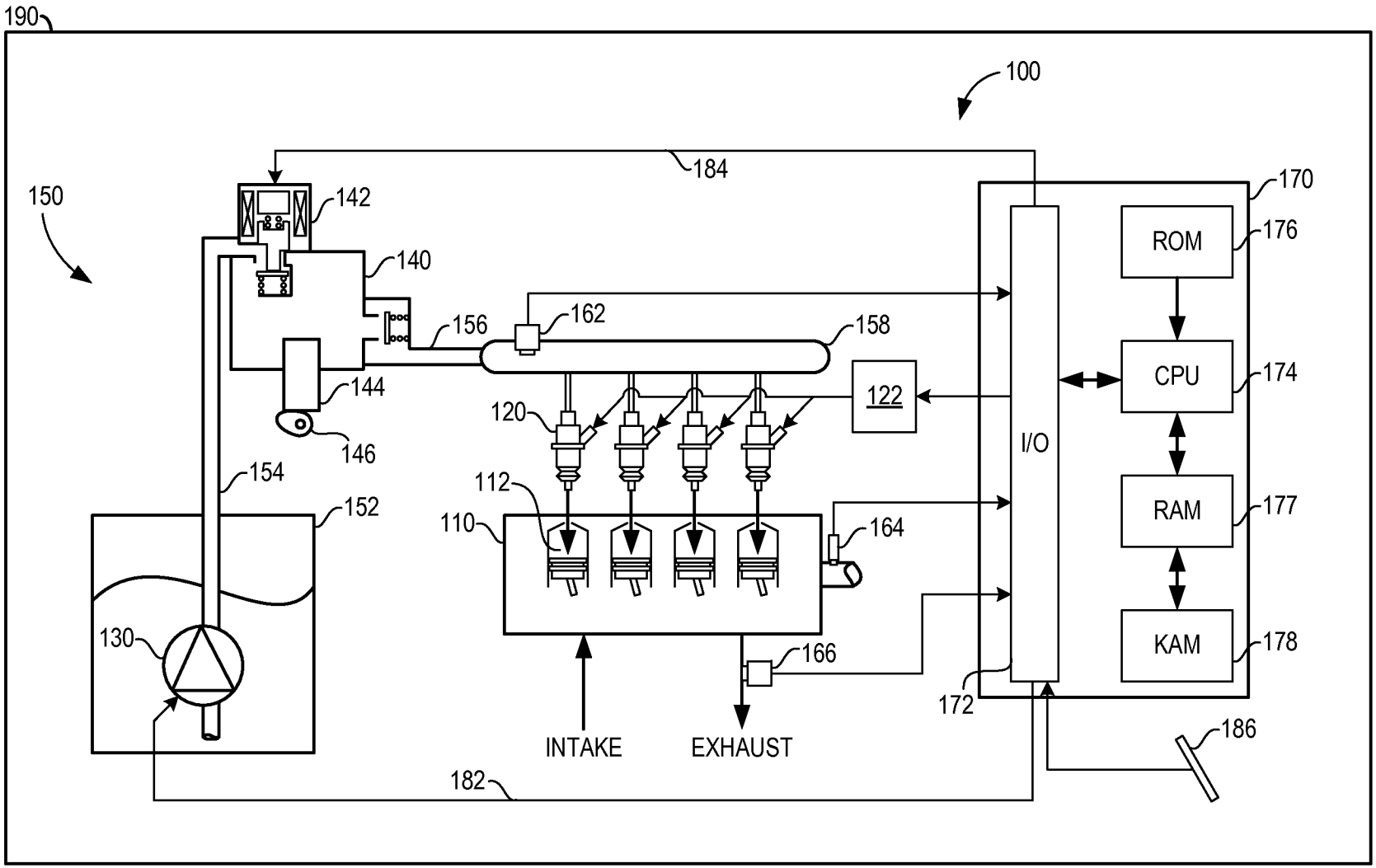
FIG. 1 shows a schematic depiction of an engine and fuel delivery system.

FIG. 1 shows an engine system 100, which may be configured as a propulsion system for a vehicle 190. Engine system 100 includes an internal combustion engine 110 having multiple combustion chambers or cylinders 112. Fuel can be provided directly to cylinders 112 via in-cylinder direct injectors 120. As indicated schematically in FIG. 1, engine 110 can receive intake air and exhaust products of the combusted fuel. Engine 110 may include a suitable type of engine including a gasoline or diesel engine.

Fuel can be provided to engine 110 via injectors 120 by way of a fuel delivery system indicated generally at 150. In this particular example, fuel delivery system 150 includes a fuel storage tank 152 for storing the fuel on-board the vehicle, a lower pressure fuel pump 130, a higher pressure fuel pump 140, a fuel rail 158, and various fuel passages 154 and 156. Thus the fuel delivery system 150 may include the lower pressure fuel pump 130 supplying fuel to the higher pressure fuel pump 140, the higher pressure fuel pump supplying fuel to at least one fuel injector 120.

The lower pressure fuel pump 130 can be operated by a controller 170 to provide fuel to higher pressure fuel pump 140 (e.g., direct injection (DI) pump) via fuel passage 154. Lower pressure fuel pump 130 can be configured as what may be referred to as a lift pump. As one example, lower pressure fuel pump 130 can include an electric pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to the lower pressure fuel pump 130, the volumetric flow rate and/or pressure increase across the pump may be reduced. The volumetric flow rate and/or pressure increase across the lower pressure fuel pump may be increased by increasing the electrical power that is provided to the lower pressure fuel pump 130. As one example, the electrical power supplied to the lower pressure fuel pump motor can be obtained from an alternator or other energy storage device on-board the vehicle 190, whereby the control system can control the electrical load that is used to power the lower pressure fuel pump. Thus, by varying the voltage and/or current provided to the lower pressure fuel pump, as indicated at 182, the flow rate and pressure of the fuel provided to higher pressure fuel pump 140 and ultimately to the fuel rail may be adjusted by the controller. Additionally, the higher pressure fuel pump 140 may be configured as a direct injection pump.

Higher pressure fuel pump 140 can be controlled by controller 170 to provide fuel to fuel rail 158 via fuel passage 156. As one non-limiting example, higher pressure fuel pump 170 may be a BOSCH HDP5 HIGH PRESSURE PUMP, which utilizes a flow control valve (e.g. MSV) indicated at 142 to enable the control system to vary the effective pump volume of each pump stroke. However, it should be appreciated that other suitable higher pressure fuel pumps may be used. An example of the higher pressure fuel pump 140 is shown in described in greater detail with reference to FIG. 1B. Higher pressure fuel pump 140 can be mechanically driven by engine 110 in contrast to the motor driven lower pressure fuel pump 130. A pump piston 144 of higher pressure fuel pump 140 can receive a mechanical input from the engine crank shaft or cam shaft via cam 146. In this manner, higher pressure fuel pump 140 can be operated according to the principle of a cam-driven single-cylinder pump.

Controller 170 can vary the pressure increase across the higher pressure fuel pump 140 and the volumetric flow rate of fuel provided by the higher pressure fuel pump 140 to fuel rail 158 by varying the command signal indicated at 184. Thus, even when the higher pressure fuel pump is operated at a pump speed that is proportionally fixed to the speed of the engine, the controller can vary the fuel pressure increase and volumetric flow rate that is provided by the higher pressure fuel pump. Fuel rail 158 can include a fuel rail pressure sensor 162 for providing an indication of fuel rail pressure to controller 170. An engine speed sensor 164 can be used to provide an indication of engine speed to controller 170. The indication of engine speed can be used to identify the speed of higher pressure fuel pump 140, since pump 140 is mechanically driven by the engine, for example, via the crankshaft or camshaft. An exhaust gas sensor 166 can be used to provide an indication of exhaust gas composition to controller 170. As one example, sensor 166 may include a universal exhaust gas sensor (UEGO). Exhaust gas sensor 166 can be used as feedback by the controller to adjust the amount of fuel that is delivered to the engine via injectors 120. In this way, controller 170 can control the air/fuel ratio delivered to the engine to a prescribed set-point.

Additionally, controller 170 can individually actuate each of injectors 120 via a fuel injection driver 122. Controller 170, driver 122, and other suitable engine system controllers can comprise a control system. While driver 122 is shown external to controller 170, it should be appreciated that in other examples, controller 170 can include driver 122 or can be configured to provide the functionality of driver 122. Controller 170, in this particular example, includes an electronic control unit comprising one or more of an input/output device 172, a central processing unit (CPU) 174, read-only memory (ROM) 176, random-accessible memory (RAM) 177, and keep-alive memory (KAM) 178. Engine controller 170 may receive various signals from sensors coupled to engine 10, including measurement of inducted mass air flow (MAF) from mass air flow sensor (not shown); engine coolant temperature (ECT) from temperature sensor (not shown); exhaust gas air/fuel ratio from exhaust gas sensor 166; operator input device 186 (i.e., throttle pedal); etc. Furthermore, engine controller 170 may monitor and adjust the position of various actuators based on input received from the various sensors. These actuators may include, for example, a throttle (not shown), intake and exhaust valve system (not shown), the lower pressure fuel pump 130, the higher pressure fuel pump 140, direct injectors 120, etc. Storage medium read-only memory 176 can be programmed with computer readable data representing instructions executable by processor 174 for performing the methods described below, as well as other variants that are anticipated but not specifically listed thereof.

In one example, the controller 170 may be configured to determine a volumetric efficiency of the higher pressure fuel pump 140 when the lower pressure fuel pump 130 is above a threshold pressure and adjust the lower pressure fuel pump output based on the volumetric efficiency of the higher pressure fuel pump. The controller 170 may be further configured to send a predetermined voltage to the lower pressure fuel pump for a predetermined period of time to raise the lower pump pressure above the threshold pressure. Additionally, the predetermined voltage may be applied to the lower pressure fuel pump in response to initiation of a higher pressure fuel pump vapor detection routine.

Further in one example, adjusting the lower pressure fuel pump output includes decreasing lift pump output if the higher pressure fuel pump's volumetric efficiency is above a threshold value and increasing the lift pump output if the higher pressure fuel pump's volumetric efficiency is below the threshold value.

Still further in one example, determining the volumetric efficiency of the higher pressure fuel pump includes measuring the volumetric efficiency of the higher pressure fuel pump. The technique for determining the volumetric efficiency is described in greater detail herein. Further in one example, the lower pressure fuel pump output may be adjusted to achieve a desired volumetric efficiency of the higher pressure fuel pump. In this way, the fuel delivery system may be efficiently operated. Still further in one example, the controller may be configured to, subsequent to adjustment of the lower pressure fuel pump output, after a predetermined time interval has been surpassed, and when the voltage sent to the lower pressure fuel pump is above the threshold value, determine a second volumetric efficiency of the higher pressure fuel pump and adjust lower pressure fuel pump output based on the second volumetric efficiency of the higher pressure fuel pump.

Figure 2:
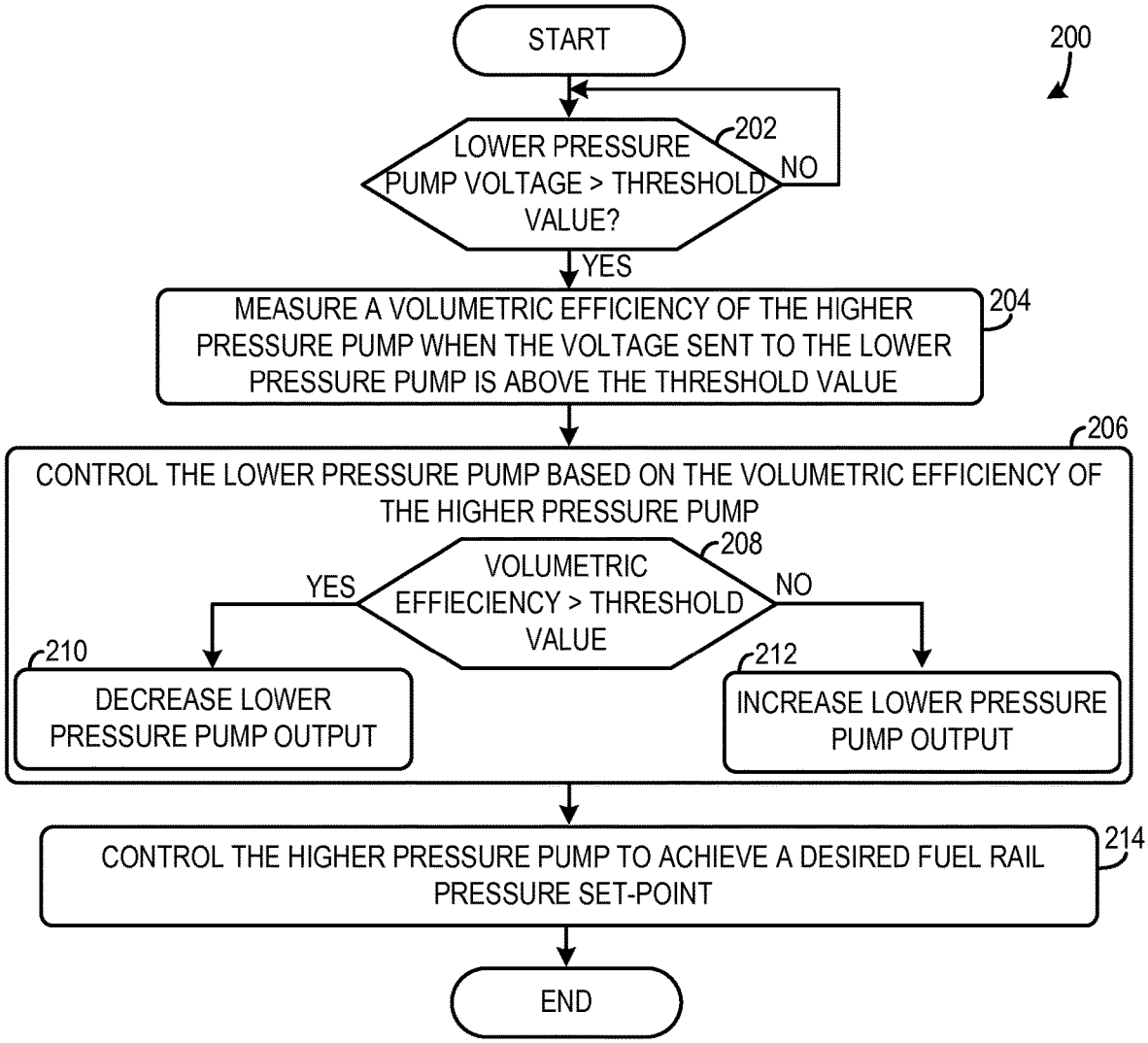
FIG. 2 shows a method for operation of a fuel delivery system.

FIG. 2 shows a method 200 for operating a fuel delivery system. The method 200 may be implemented via the fuel delivery system described above with regard to FIG. 1 or may be implemented via another suitable fuel delivery system.

At 202 the method includes determining if a voltage (e.g., voltage pulse) sent to the lower pressure pump is greater than a threshold value. It will be appreciated that the lower pressure pump pressure can be inferred from the voltage sent to the lower pressure pump. Therefore, it may be inferred that the pressure of the lower pressure pump is greater than a threshold value when the voltage sent to the lower pressure pump is greater than a threshold value. Thus in one example, a lower pressure pump pressure sensor may not be included in the fuel delivery system, if desired.

If it is determined that the voltage sent to the lower pressure fuel pump does not exceed the threshold value (NO at 202) the method returns to 202. However, if it is determined that the pressure of the lower pressure fuel pump exceeds the threshold pressure (YES at 202) the method advances to 204. At 204 the method includes determining a volumetric efficiency of the higher pressure fuel pump when the voltage sent to the lower pressure fuel pump is above the threshold value. In one example, when the voltage sent to the lower pressure pump falls below a threshold value and/or the higher pressure fuel pump efficiency falls below a threshold value, a voltage pulse above a threshold value may be sent to the lower pressure pump. Additionally or alternatively, a voltage pulse above a threshold value may be sent to the lower pressure pump when a predetermined amount of fuel (e.g., 3 cubic centimeters (CC)) is consumed by the engine. At 206 the method including controlling the lower pressure fuel pump based on the volumetric efficiency of the higher pressure fuel pump. In one example, the volumetric efficiency may be determined utilizing an additive correction term added to a modeled volumetric efficiency. It will be appreciated that determining the volumetric efficiency in this way does not require an accurate pump model. It merely needs a structurally correct pump model with an additive correction term. The additive correction term may be computed as follows:

$$\text{Volumetric Efficiency Additive Term} = \text{Modeled Volumetric Efficiency} - \text{Actual Volumetric Efficiency} \quad \text{(equation 1)}$$

In one example, Modelled Volumetric Efficiency may be calculated using the following equation $$\text{Modeled Volumetric Efficiency} = 1 - A - (B^{*}\text{DC}^{*}\text{FRP}/N) - (C^{*}\text{FRP}^{*}\text{DC}) \quad \text{(equation 2)}$$

A=offset term
B=leak term
C=compressibility term
DC=duty cycle
FRP=Fuel Rail Pressure
N=Engine Speed Therefore in one example, a Corrected Volumetric Efficiency may be determined using the following equation.

$$\text{Corrected Volumetric Efficiency} = \text{Modeled Volumetric Efficiency} + \text{Volumetric Efficiency Additive Term} \quad \text{(equation 3)}$$

Thus in one example, the lower pressure fuel pump may be adjusted by the controller based on the difference between the Corrected Volumetric Efficiency (i.e., the desired volumetric efficiency) and the Actual Volumetric Efficiency (i.e., the volumetric efficiency we have). Therefore, the following equation may be used to adjust the lower pressure fuel pump.

The Volumetric Efficiency Additive Term may be learned and computed as a function of other variables such as DC*FRP/N or FRP*DC $$\text{Volumetric Efficiency Degradation} = \text{Corrected Volumetric Efficiency} - \text{Actual Volumetric Efficiency} \quad \text{(equation 4)}$$

Therefore in such an example, when the Volumetric Efficiency Degradation is above a threshold, the lower pressure fuel pump output is increased and when the Volumetric Efficiency Degradation is below the threshold lower pressure fuel pump output is decreased. It will be appreciated that the lower pressure fuel pump output may be adjusted through the adjustment of voltage provided to the lower pressure fuel pump. For instance, voltage provided to the pump may be increased to increase the output and conversely the voltage provided to the pump may be decreased to decrease pump output. In this way, the lower pressure fuel pump is controlled based on an additive correction term determined using the volumetric efficiency determined at 204.

In one example, controlling the lower pump based on the volumetric efficiency of the higher pressure fuel pump may include at 208 determining if the volumetric efficiency of the higher pressure fuel pump is greater than a threshold value. The threshold value may be determined based the equations related to volumetric efficiency and the additive correction term discussed above. A threshold of 15 to 30% of allowed volumetric efficiency degradation has found to be effective. Lower than 15% risks the lift pump being turned on from noise in the volumetric efficiency measure. Greater than 30% risks insufficient reaction time to re-pressurize the fuel line between the lift pump and the DI pump inlet.

If the volumetric efficiency is greater than the threshold value (YES at 208) the method includes at 210 decreasing lower pressure fuel pump output. However, if the volumetric efficiency is not greater than the threshold value (NO at 208) the method includes at 212 increasing lower pressure fuel pump output. Next at 214 the method includes controlling the higher pressure fuel pump to achieve a desired fuel rail pressure set-point.

It will be appreciated that the method 200 may be repeated and therefore the method may further include when a voltage sent to the lower pressure fuel pump is above the threshold value, determining a second volumetric efficiency of the higher pressure fuel pump and adjusting lower pressure fuel pump output based on the second volumetric efficiency of the higher pressure fuel pump.

Figure 3:
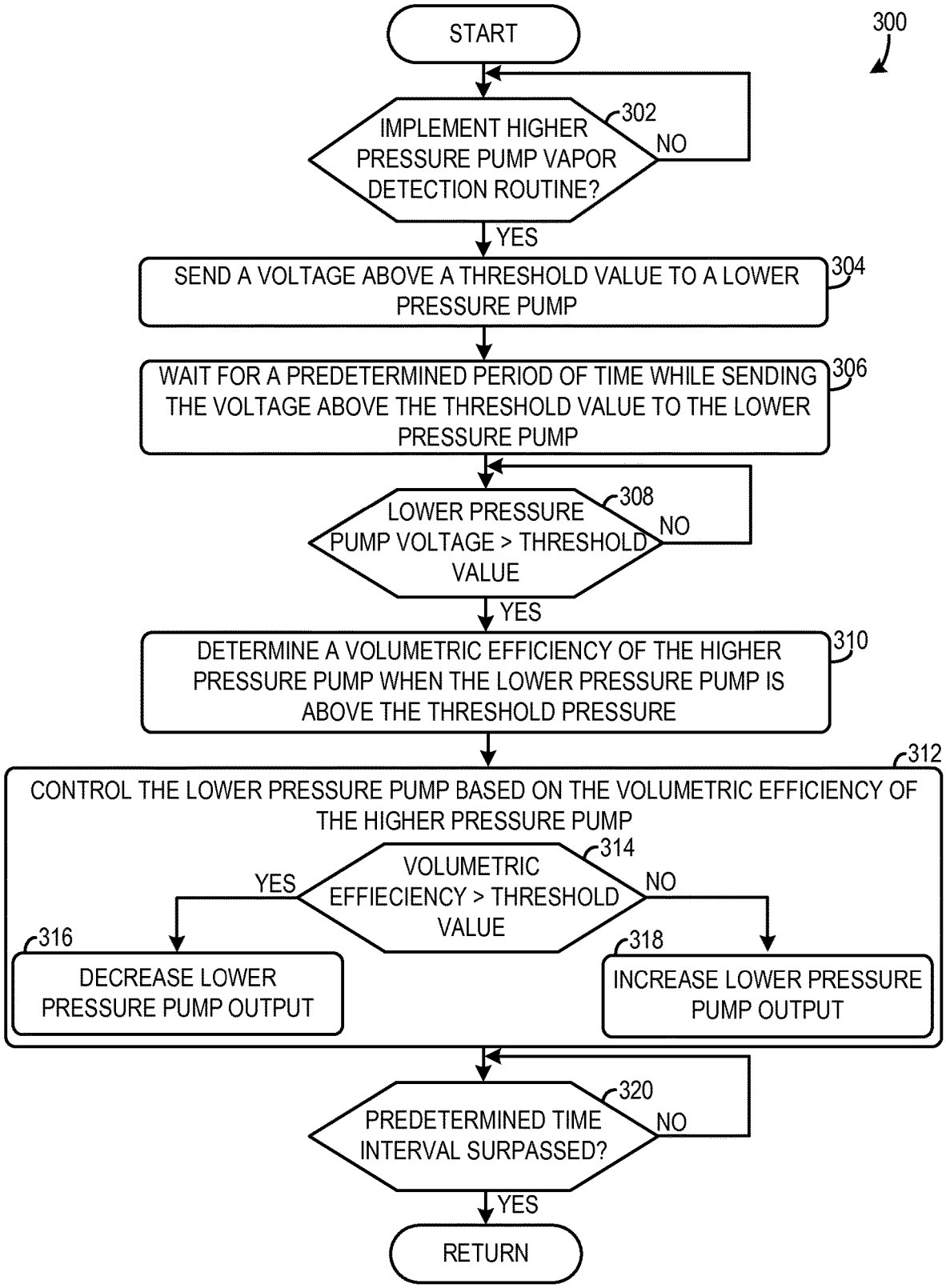
FIG. 3 shows another method for operation of a fuel delivery system.

FIG. 3 shows a method 300 for operating a fuel delivery system. The method 300 may be implemented via the fuel delivery system described above with regard to FIG. 1 or may be implemented via another suitable fuel delivery system.

At 302 the method includes determining if a higher pressure fuel pump vapor detection routine should be implemented. Implementing a vapor detection routine may include increasing the output of the lower pressure fuel pump and measuring a fuel rail pressure, in one example.

If it is determined that the higher pressure fuel pump vapor detection routine should not be implemented (NO at 302) the method returns to 302. However, if it is determined that the higher pressure fuel pump vapor detection routine should be implemented (YES at 302) the method advances to 304. At 304 the method includes sending a voltage above a threshold value to a lower pressure fuel pump in response to implementing the higher pressure fuel pump vapor detection routine. However, in other examples the vapor detection routine may not be implemented in step 302. Further in one example, the threshold value may be 10 volts (V). In another example, the threshold value may be 12V. In this way, the lower pressure fuel pump output pressure is increased.

At 306 the method includes waiting for a predetermined period of time while sending the voltage over the threshold value to the lower pressure fuel pump. In one example, the predetermined period of time may be 0.24 seconds, in one example, or 150 milliseconds in another example.

At 308 the method determines if the pressure of the voltage sent to the lower pressure fuel pump is greater than a threshold value. However, in other examples step 308 may not be included in the method 300 and it may be inferred that the voltage sent to the lower pressure fuel pump is greater than the threshold value and therefore the lower pressure pump pressure is greater than a threshold value. If it is determined that the voltage sent to the lower pressure fuel pump is not greater than the threshold value (NO at 308) the method returns to 308. However, if it is determined that the voltage sent to the lower pressure fuel pump is greater than the threshold value (YES at 308) the method advances to 310. At 310 the method includes determining a volumetric efficiency of the higher pressure fuel pump when the lower pressure fuel pump is above the threshold pressure. The volumetric efficiency of the higher pressure fuel pump may be determined based on the technique described above. In one example, when the voltage sent to the lower pressure pump falls below a threshold value and/or the higher pressure fuel pump efficiency falls below a threshold value, a voltage pulse above a threshold value may be sent to the lower pressure pump. Additionally or alternatively, a voltage pulse above a threshold value may be sent to the lower pressure pump when a predetermined amount of fuel (e.g., 3 cubic centimeters (CC)) is consumed by the engine.

At 312 the method includes controlling the lower pressure fuel pump based on the volumetric efficiency of the higher pressure fuel pump. In one example, the lower pressure fuel pump may be controlled based on the additive correction term discussed above. Controlling the lower pressure fuel pump based on the volumetric efficiency of the higher pressure fuel pump may include steps 314-318. At 314 the method determines if the volumetric efficiency of the higher pressure fuel pump is greater than a threshold value.

If it is determined that the volumetric efficiency is greater than the threshold value (YES at 314) the method advances to 316. At 316 the method includes decreasing lower pressure fuel pump output. On the other hand, if it is determined that the volumetric efficiency is not greater than the threshold value (NO at 314) the method advances to 318. At 318 the method includes increasing the lower pressure fuel pump output. In the depicted example, the method may be implemented at predetermined time intervals during engine operation. Thus, at 320 the method determines if a predetermined time interval has surpassed. If the predetermined time interval has not surpassed (NO at 320) the method returns to 320 and continues to wait without repeating the method. However, if the predetermined time interval has surpassed (YES at 320) the method returns to the start. Method 300 enables the volumetric efficiency of the higher pressure pump to be measured at selected time intervals which enable the accuracy of the measurement to be increased. Consequently, subsequent operation of the higher pressure fuel pump can be improved.

Figure 4:
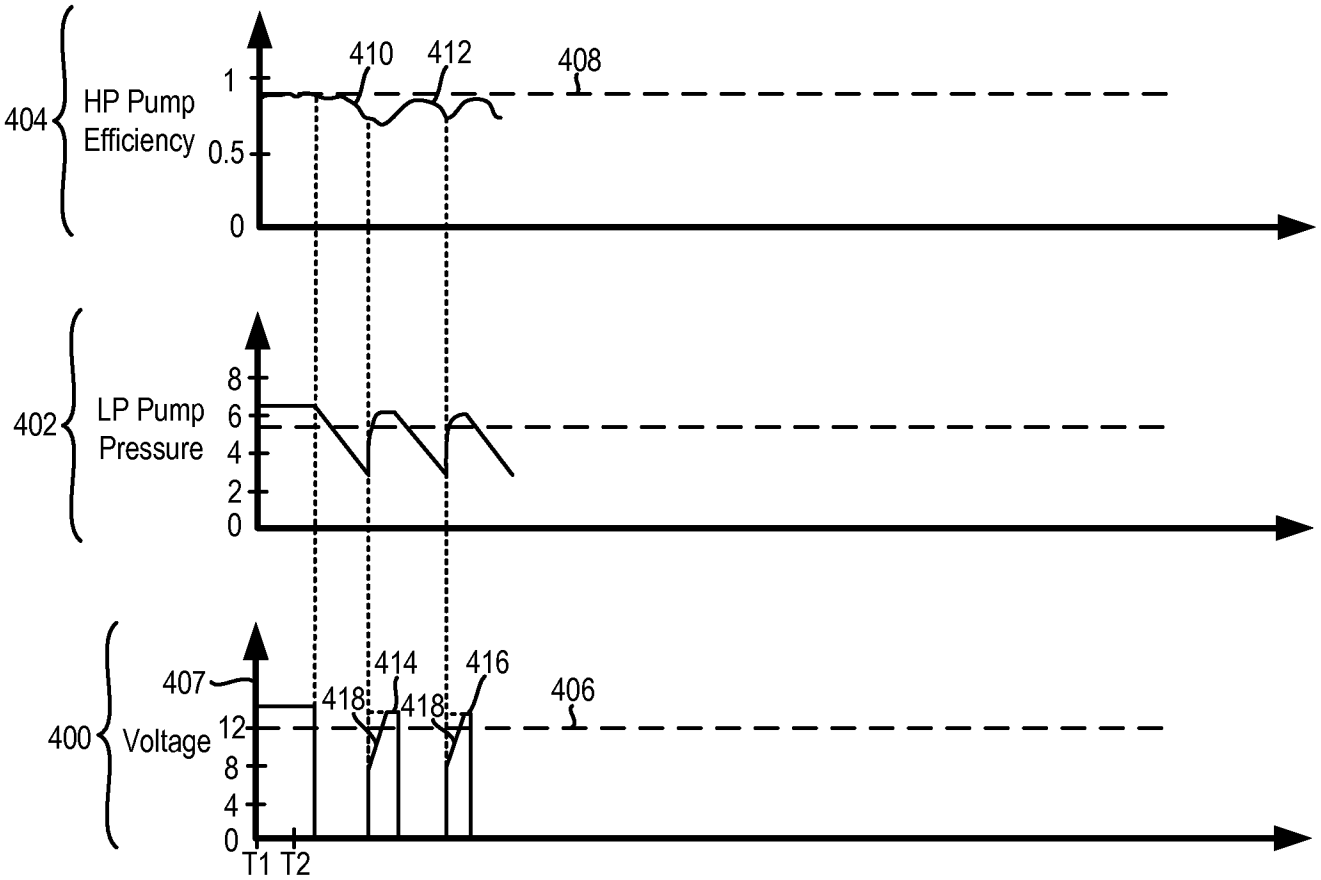
FIG. 4 shows a graphical representation of an example fuel delivery system control routine.

FIG. 4 shows a timeline depicting an example lower pressure fuel pump control operation. In this example, time is indicated along the horizontal axis. Voltage applied to the lower pressure fuel pump is indicated on the vertical axis of graph 400. The pressure of the lower pressure fuel pump is indicated on the vertical axis of graph 402 and the higher pressure fuel pump efficiency is indicated on the vertical axis of graph 404.

At T1 the voltage applied to the lower pressure fuel pump is increased to a value greater than a threshold value 406. In the depicted example the threshold voltage is 12V. However, alternate voltages have been contemplated. The voltage can be sent to the lower pressure fuel pump in pulses. However, alternate electronic pump control techniques may be utilized. As shown, the efficiency of the higher pressure pump is at or near a peak value 408 when the high voltage pulse is applied to the lower pressure pump. It will be appreciated that the volumetric efficiency of the higher pressure pump increases as the lower pressure pump voltage (or pressure) is increased. Once the lower pressure pump voltage (or pressure) is sufficient, the volumetric efficiency reaches the peak value 408 and no longer substantially increases with extra lower pressure pump pressure. As such, the lower pressure pump voltage (or pressure) is so high, that maximum higher pressure pump volumetric efficiency is essentially assured. It is at that point T2 that the higher pressure pump volumetric efficiency can be learned. As shown, at 410 and 412 the higher pressure fuel pump efficiency decreases when the high voltage sent to the lower pressure pump is discontinued. In response to the decrease in pump efficiency, voltage pulses 414 and 416 are sent to the lower pressure fuel pump. However, other lower pressure pump control techniques have been contemplated. The voltage pulses 414 and 416 can include slowed voltage ramps 418 to reduce (e.g., limit) peak pump motor current. In this way, the higher pressure fuel pump efficiency may be accurately measured at predetermined intervals. As a result, control of both the higher and lower pressure fuel pumps can be improved.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating an engine fuel delivery system, comprising:

operating a lift pump at a voltage below a threshold value;

sending a voltage above the threshold value to the lift pump until a predetermined period of time has passed and a predetermined amount of fuel has been consumed by the engine, and then determining a volumetric efficiency of a direct injection pump; and controlling the lift pump based on the volumetric efficiency of the direct injection pump, wherein the volumetric efficiency of the direct injection pump on which the controlling of the lift pump is based is determined only when the voltage sent to the lift pump has been above the threshold value for the predetermined period of time, and wherein the threshold value is at least 10 V.

2. The method of claim 1, where controlling the lift pump includes decreasing lift pump output if the volumetric efficiency of the direct injection pump is above a volumetric efficiency threshold value and increasing the lift pump output if the volumetric efficiency of the direct injection pump is below the volumetric efficiency threshold value.

3. The method of claim 1, where sending the voltage above the threshold value to the lift pump is initiated responsive to implementation of a direct injection pump vapor detection routine, and wherein the direct injection pump vapor detection routine includes sending the voltage above the threshold value to the lift pump and measuring a fuel rail pressure.

4. The method of claim 1, wherein the volumetric efficiency is a first volumetric efficiency, wherein controlling the lift pump comprises adjusting lift pump output, the method further comprising:

subsequent to adjustment of the lift pump output, after a predetermined time interval has been surpassed, sending the voltage above the threshold value to the lift pump, waiting for the predetermined period of time while sending the voltage above the threshold value to the lift pump, and then determining a second volumetric efficiency of the direct injection pump and adjusting the lift pump output based on the second volumetric efficiency of the direct injection pump, wherein the second volumetric efficiency of the direct injection pump on which the adjusting of the lift pump output is based is determined only when the voltage sent to the lift pump has been above the threshold value for the predetermined period of time.

5. The method of claim 1, where the lift pump is controlled based on an additive correction term determined by subtracting the volumetric efficiency of the direct injection pump from a modeled volumetric efficiency of the direct injection pump.

6. The method of claim 1, wherein the predetermined period of time is 150 milliseconds or 240 milliseconds.

7. The method of claim 1, wherein the volumetric efficiency of the direct injection pump is a peak value which does not substantially increase with extra pressure output by the lift pump.

8. The method of claim 1, wherein controlling the lift pump based on the volumetric efficiency of the direct injection pump includes sending voltage pulses to the lift pump.

9. The method of claim 8, wherein sending the voltage pulses to the lift pump includes sending voltage ramps to the lift pump.

10. A fuel delivery system for an engine comprising:

a low pressure fuel pump supplying fuel to a high pressure fuel pump, the high pressure fuel pump supplying fuel to at least one fuel injector; and a controller configured to:

operate the low pressure fuel pump at a voltage below a threshold value;

implement a direct injection pump vapor detection routine that includes sending a predetermined voltage above the threshold value to the low pressure fuel pump;

perform a volumetric efficiency determination of the high pressure fuel pump concurrent with the direct injection pump vapor detection routine, the volumetric efficiency determination including, upon the predetermined voltage above the threshold value being sent to the low pressure fuel pump, waiting for a predetermined period of time and waiting until a predetermined amount of fuel has been consumed by the engine while sending the predetermined voltage to the low pressure fuel pump, and then determining a volumetric efficiency of the high pressure fuel pump; and adjust low pressure fuel pump output based on the volumetric efficiency of the high pressure fuel pump, wherein the threshold value is 10 V.

11. The fuel delivery system of claim 10, where the controller is further configured to send the predetermined voltage to the low pressure fuel pump for the predetermined period of time to raise low pressure fuel pump pressure above a threshold value, and wherein the adjusting of the low pressure fuel pump output based on the volumetric efficiency of the high pressure fuel pump is performed during operation of the low pressure fuel pump, the controller being an electronic controller with non-transitory memory holding instructions in cooperation with one or more sensors and an actuator to adjust the low pressure fuel pump output, the actuator including a pump motor.

12. The fuel delivery system of claim 10, where adjusting the low pressure fuel pump output includes decreasing the low pressure fuel pump output if the volumetric efficiency of the high pressure fuel pump is above a volumetric efficiency threshold value and increasing the low pressure fuel pump output if the volumetric efficiency of the high pressure fuel pump is below the volumetric efficiency threshold value.

13. The fuel delivery system of claim 10, where determining the volumetric efficiency of the high pressure fuel pump includes adding an additive correction term to a modeled volumetric efficiency of the high pressure fuel pump.

14. The fuel delivery system of claim 10, where the low pressure fuel pump output is adjusted to achieve a desired volumetric efficiency of the high pressure fuel pump.

15. The fuel delivery system of claim 10, wherein the volumetric efficiency is a first volumetric efficiency, where the controller is further configured to, subsequent to adjustment of the low pressure fuel pump output, send the predetermined voltage to the low pressure fuel pump; wait for the predetermined period of time while sending the predetermined voltage to the low pressure fuel pump, and then determine a second volumetric efficiency of the high pressure fuel pump; and adjust the low pressure fuel pump output based on the determined second volumetric efficiency of the high pressure fuel pump.

16. The fuel delivery system of claim 10, wherein the volumetric efficiency of the high pressure fuel pump is a maximum volumetric efficiency of the high pressure fuel pump.

17. A method for operating a fuel delivery system for an engine, comprising:

operating a lift pump at a voltage below a threshold voltage value;

implementing a direct injection pump vapor detection routine that includes sending a voltage above the threshold voltage value to the lift pump;

performing a volumetric efficiency determination of a direct injection pump concurrent with the direct injection pump vapor detection routine, the volumetric efficiency determination including, upon sending the voltage above the threshold voltage value to the lift pump, waiting for a predetermined period of time and waiting until a predetermined amount of fuel has been consumed by the engine while sending the voltage above the threshold voltage value to the lift pump, and then determining a volumetric efficiency of the direct injection pump; and decreasing lift pump output if the volumetric efficiency of the direct injection pump is above a threshold volumetric efficiency value and increasing the lift pump output if the volumetric efficiency of the direct injection pump is below the threshold volumetric efficiency value, wherein the threshold voltage value is at least 10V.

18. The method of claim 17, wherein the volumetric efficiency is a first volumetric efficiency, and further comprising, subsequent to decreasing or increasing the lift pump output, sending the voltage above the threshold voltage value to the lift pump; waiting for the predetermined period of time while sending the voltage above the threshold voltage value to the lift pump, and then determining a second volumetric efficiency of the direct injection pump; and adjusting the lift pump output based on the second volumetric efficiency of the direct injection pump.

19. The method of claim 17, where the lift pump is controlled based on an additive correction term determined by subtracting the volumetric efficiency of the direct injection pump from a modeled volumetric efficiency of the direct injection pump.

20. The method of claim 17, wherein the volumetric efficiency of the direct injection pump is a maximum volumetric efficiency of the direct injection pump.

* * * * *